US009624663B2

(12) United States Patent
Wingfield

(10) Patent No.: US 9,624,663 B2
(45) Date of Patent: Apr. 18, 2017

(54) THERMAL BARRIER IN BUILDING STRUCTURES

(75) Inventor: Allan Wingfield, Fairview, NC (US)

(73) Assignee: LOW & BONAR B.V., Arnhem (NL)

( * ) Notice: Subject to any disclaimer, the term of this patent is extended or adjusted under 35 U.S.C. 154(b) by 909 days.

(21) Appl. No.: 13/062,589

(22) PCT Filed: Aug. 26, 2009

(86) PCT No.: PCT/IB2009/053739
§ 371 (c)(1),
(2), (4) Date: Mar. 7, 2011

(87) PCT Pub. No.: WO2010/026510
PCT Pub. Date: Mar. 11, 2010

(65) Prior Publication Data

US 2011/0271637 A1 Nov. 10, 2011

Related U.S. Application Data

(60) Provisional application No. 61/136,445, filed on Sep. 5, 2008.

(51) Int. Cl.
*E04B 1/70* (2006.01)
*E04B 7/22* (2006.01)
*E04D 13/16* (2006.01)

(52) U.S. Cl.
CPC ..... *E04B 7/22* (2013.01); *E04D 13/1618* (2013.01); *Y10T 428/2457* (2015.01); *Y10T 428/24752* (2015.01); *Y10T 428/249923* (2015.04); *Y10T 428/249953* (2015.04)

(58) Field of Classification Search
CPC ..... E04B 7/22; E04D 13/1618; Y10T 428/249953; Y10T 428/249923; Y10T 428/24752; Y10T 428/2457
USPC ..... 52/199, 302.1
See application file for complete search history.

(56) References Cited

U.S. PATENT DOCUMENTS 2,671,441 A * 3/1954 Harris ..... 126/621
3,909,998 A * 10/1975 Simpson et al. ..... 52/223.6
4,073,997 A * 2/1978 Richards et al. ..... 442/374
4,201,193 A * 5/1980 Ronc ..... 126/623
(Continued)

FOREIGN PATENT DOCUMENTS

DE 20 07 688 A1 9/1971
EP 1 655 421 A2 5/2006

OTHER PUBLICATIONS

Feb. 15, 2010 International Search Report issued in PCT Patent Application No. PCT/IB2009/053739.
(Continued)

*Primary Examiner* — Brian Glessner
*Assistant Examiner* — Joshua Ihezie
(74) *Attorney, Agent, or Firm* — Oliff PLC

(57) ABSTRACT

A building structure includes a base structure (10), a thermal barrier layer (20) and an external layer (30). The thermal barrier layer may be a three-dimensional matrix of filaments. The filaments may be irregularly looped and intermingled in a highly porous, three-dimensional structure with a large open space. The filaments form a thermal barrier by reducing the physical contact between the external layer and the base structure. The filament material is low in conductivity, so little heat transfer occurs between the external layer and the filaments.

30 Claims, 2 Drawing Sheets

(56) References Cited

U.S. PATENT DOCUMENTS

| | | | | | |
|---|---|---|---|---|---|
| 4,212,692 | A | * | 7/1980 | Rasen et al. | 156/167 |
| 4,252,590 | A | * | 2/1981 | Rasen et al. | 156/167 |
| 4,315,392 | A | * | 2/1982 | Sylvest | 52/309.1 |
| 4,342,807 | A | | 8/1982 | Rasen et al. | |
| RE31,599 | E | | 6/1984 | Rasen et al. | |
| 4,769,526 | A | * | 9/1988 | Taouil | 219/213 |
| 5,099,627 | A | * | 3/1992 | Coulton et al. | 52/408 |
| 5,251,416 | A | | 10/1993 | White | |
| 5,456,876 | A | * | 10/1995 | Redwine et al. | 264/555 |
| 5,960,595 | A | * | 10/1999 | McCorsley et al. | 52/199 |
| 6,131,353 | A | * | 10/2000 | Egan | 52/408 |
| 6,804,922 | B1 | * | 10/2004 | Egan | 52/408 |
| 6,976,337 | B2 | * | 12/2005 | Hiraki | 52/79.1 |
| 7,654,051 | B2 | * | 2/2010 | Pollack | 52/302.1 |
| 7,788,868 | B2 | * | 9/2010 | Pollack | 52/302.1 |
| 8,065,854 | B1 | * | 11/2011 | Doberstein et al. | 52/746.11 |
| 2005/0055889 | A1 | * | 3/2005 | Thaler | 52/58 |
| 2007/0257227 | A1 | * | 11/2007 | Yamada et al. | 252/62 |
| 2009/0130939 | A1 | * | 5/2009 | Kimura et al. | 442/364 |
| 2010/0095622 | A1 | * | 4/2010 | Niemoller | 52/407.5 |

OTHER PUBLICATIONS

Written Opinion of the International Searching Authority issued in International Patent Application No. PCT/IB2009/053739 on Feb. 15, 2010.

International Preliminary Report on Patentability issued in International Patent Application No. PCT/IB2009/053739 on Dec. 20, 2010.

* cited by examiner

THERMAL BARRIER IN BUILDING STRUCTURES

TECHNICAL FIELD

This invention relates to a thermal barrier in building structures, such as roof structures or wall structures, and to methods of producing roof structures having such thermal barriers.

DISCLOSURE OF INVENTION

The external layer of some roof structures or other building structures (such as walls) is a material with relatively high heat conductivity, compared to other materials. Metal roofs and asphalt shingles are examples of external layers that have more heat conductivity than wood shingles or ceramic tiles. For example, aluminium layers may have a heat conductivity of 204-249 W/(m K) (that is, Watts/(meter Kelvin)), copper layers may have a heat conductivity of 353-385 W/(m K), steel layers may have a heat conductivity of 29-54 W/(m K), zinc layers may have a heat conductivity of about 116 W/(m K), titanium layers may have a heat conductivity of 19-23 W/(m K), and stainless steel layers may have a heat conductivity of about 14 W/(m K). Asphalt shingles layers may have a heat conductivity of about 0.5 W/(m K). In contrast, wood shingle layers may have a heat conductivity of 0.04-0.4 W/(m K). Because of this relatively high heat conductivity of metal roofing layers and asphalt shingle layers, such external layers can transmit a large amount of heat (or cold) to the underlying substrate, potentially causing long-term damage to the substrate, and/or causing thermal inefficiency of the building as a whole. For example, in a structural insulated panel system (SIPS) in which, typically, an insulating foam core is sandwiched between two layers of wood sheathing panels and laminated to the wood sheathing, high temperatures from conducted heat can cause delamination of the wood sheathing from the foam core.

To reduce such transmission of heat or cold, embodiments of the present invention provide a thermal barrier in a building structure such as a roof structure or a wall structure. Thus, for example, the building structure may comprise a base structure, a thermal barrier layer and an external layer having a relatively high thermal conductivity. The thermal barrier layer may include a three-dimensional matrix of filaments. The filaments may be irregularly looped and intermingled in a highly porous, three-dimensional structure with a large open space. The filaments form a thermal barrier by reducing the physical contact between the external layer and the base structure. The filament material may be low in conductivity, so that little heat transfer occurs between the external layer and the filaments.

BRIEF DESCRIPTION OF DRAWINGS

Exemplary embodiments will be described with reference to the attached drawings, in which like numerals represent like parts, and in which.

MODE(S) FOR CARRYING OUT THE INVENTION

Figure 1:
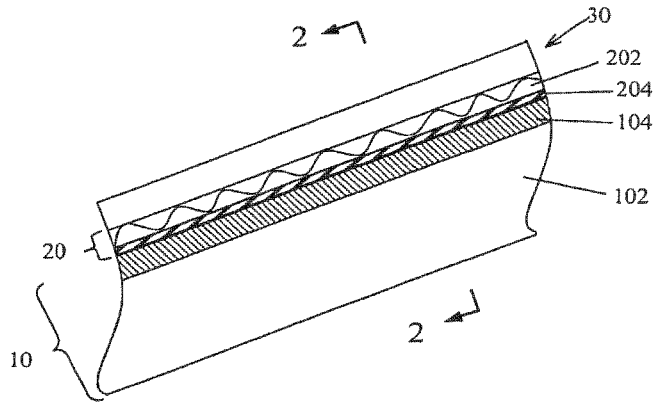
FIG. 1 illustrates a first exemplary roof structure.
Figure 2:
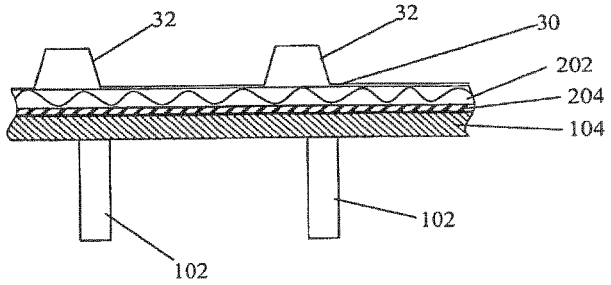
FIG. 2 is a cross sectional view taken along line 2-2 of FIG. 1.

FIG. 1 illustrates a first exemplary roof structure according to this invention, and FIG. 2 is a cross sectional view taken along line 2-2 of FIG. 1. The roof structure includes a base structure 10, a thermal barrier layer 20 and an external layer 30. The base structure 10 of this example includes truss members 102 and a sheathing layer 104 fastened to the truss members 102 in a known manner. For example, the sheathing layer 104 may be plywood that is nailed, stapled or screwed to the truss members 102.

The thermal barrier layer 20 includes a three-dimensional matrix 202. In embodiments, for example, the matrix 202 can be made from a tangled net of polymer, preferably nylon, polyester or high density polyethylene. Other examples of polymers include, but are not limited to, low density polyethylene, medium density polyethylene, polyolefins, polyvinyl chloride, polyester, polyimides, polyethylene terephthalate (PET), polyamides, polyurethane, polyethylene, polypropylene, poly(4-methylbutene), polystyrene, polymethacrylate, poly(ethylene terephthalate), poly(vinyl butyrate) and the like.

The matrix 202 may be made of extruded filaments that are randomly laid down on a forming substrate and bonded where they cross. The filaments may be irregularly looped and intermingled in a highly porous, three-dimensional structure with a large open space. The "open space" of the matrix 202, in this context, is defined as the total volume between two planes sandwiching the matrix 202 over a given area, minus the volume occupied by the filaments themselves, as a percentage. The open space may, for example, be at least 75%, such as about 80%, or about 85%, or about 90%, or about 95%, or greater than 95%, such as about 98%.

The filaments may be heat fused to one another at randomly spaced points. The thickness of the matrix 202 can be any desired value. For example, the thickness may be from about 2 mm to about 50 mm or greater, or in any range between 2 mm and 50 mm. In general, increasing the thickness decreases the amount of heat or cold that is transmitted through the roof structure. For example, although only a relatively small thickness, such as from about 2 mm to about 10 mm, should be sufficient to provide a good barrier against thermal conduction, a somewhat greater thickness, such as from about 10 mm to about 25 mm or greater, should be more effective against transmission of thermal energy by radiation and/or convection. Thicknesses in a range of from about 5 mm to about 25 mm, such as from about 10 mm to about 20 mm, provide a good thermal barrier while avoiding the potential decrease in compressive strength that can accompany matrices of a greater thickness. Lesser thicknesses, such as thicknesses in a range of from about 2 mm to about 5 mm, should have the advantage of greater compressive strength, which may be advantageous for certain applications such as asphalt shingle roofs.

The matrix 202 may have a peak and valley configuration. U.S. Pat. No. 4,342,807, the entire contents of which are incorporated herein by reference, discloses a matrix having a peak and valley configuration. Examples of a suitable three-dimensional matrix include, but are not limited to, ENKAMAT® and ENKADRAIN®, which are manufactured by Colbond Inc. of Enka, N.C. U.S. Pat. Nos. 4,212,692; 4,252,590; and Re. 31,599, the entire contents of each of which are herein incorporated by reference, disclose various three-dimensional matrices and processes for making the matrices.

The thermal barrier layer 20 may also include a layer 204. The layer 204 may be used to provide additional strength to the thermal barrier 20. The layer providing additional strength may be a scrim to stop or reduce tearing and/or to increase the tensile properties of the thermal barrier. The scrim can, for example, be made of fibreglass, coated fibreglass, polyester, high tenacity nylon, or E-glass. The scrim can be made using a variety of weaves from a very open grid like structure to a tighter weave in a number of patterns including but not limited to plain, leno, satin, twill, mock leno, and basket weave as manufactured for example by Dewtex Inc., Scrimco Inc, Raven Industries-Dura-Skrim and Tectum Weaving Inc. The layer providing additional strength may also be a nonwoven layer, such as a melt blown polymer web or a spunbonded polymer web. An example of a suitable spunbonded polymer web includes, but is not limited to, Colback® which is manufactured by Colbond Inc. of Enka, N.C., USA. The layer may be a waterproof membrane, a water-resistant membrane, or a waterproof breathable membrane. Alternatively or additionally, the layer 204 may be a radiant barrier membrane that reduces the transmission of radiant energy. Various properties, such as waterproofness and reduction of the transmission of radiant energy, may be provided by a single layer 204. Alternatively, multiple layers 204 may be provided to achieve various desired properties. Although the layer 204 is depicted underneath the matrix 202, it may instead be positioned over the matrix 202. Alternatively, one or more layers 204 may be provided underneath the matrix 202 and one or more layers 204 may be provided over the matrix 202, each layer imparting one or more desired properties to the roof structure as a whole. Some examples of materials that may be used for the layer 204 are: Typar™, a breathable bi-component microporous membrane of high strength polypropylene; VaproShield™; WallShield™; WrapShield™ or SlopeShield™, which are breathable, moisture-permeable, water-shedding membranes of tri-laminate construction of flash spunbonded high density polypropylene; Tyvek™, a spunbonded polyethylene non-woven that resists water and air penetration while allowing water vapor to pass; other microporous breathable underlayments comprised of coated woven and/or non-woven fabrics or breathable materials comprised of a fabric layer and a polymer film layer thereon, the polymer film layer comprising a polymer composition and a filler, wherein the breathable material has undergone a physical manipulation to render the polymer film layer microporous; Fortifiber Jumbo Tex™, a high-performance water-resistive barrier of asphalt saturated kraft building paper of 1 or 2 plies; and Grace Ultra™ or similar self adhering waterproof roof underlayments made of butyl rubber backed by a layer of high density cross laminated polyethylene.

The matrix 202 and the layer 204 may be attached to the base structure 10 in separate steps, by stapling, nailing, gluing or the like. Alternatively, the matrix 202 and the layer 204 may be joined together in advance to form a composite material, and then the composite material may be attached to the base structure 10 by stapling, nailing, gluing or the like. For example, to form a composite material in advance, the matrix 202 and the layer 204 may, for example, be attached together by an adhesive, or by contacting and holding the layer 204 against the matrix 202 while the matrix 202 is in a partially melted state or uncured state and then allowing the matrix to cure and/or harden.

An adhesive used to bind the layer 204 to the matrix 202 may be a hot melt adhesive. Specific examples of appropriate adhesives include, but are not limited to, isobutylene, acrylic and methacrylic acid ester resins, cyanoacrylates, phenoformaldehyde, urea-aldehyde, melamine-aldehyde, hydrocarbon resins, polyethylene, polyolefin, nylon, polystyrene resins and epoxies, polyethylene and polyamides. VESTOPLAST™ 703 or 750, manufactured by Huls America, may be used.

The adhesive may be applied (e.g., sprayed or rolled) on one surface of the layer 204 or the matrix 202. For example, the matrix 202 may be coated with the adhesive where contact with the layer 204 will be made. This can be achieved using a kiss roll or other suitable applicator. The matrix 202 is then attached to the layer 204 before the adhesive sets or otherwise hardens. After the layer 204 and the matrix 202 are attached, the composite material can be rolled onto a spool for ease in shipping and storage.

As another example, the matrix 202, and optionally the layer 204, may be incorporated into or fastened onto a pre-fabricated panel, such as a panel used in structural insulated panel system (SIPS) in which, typically, an insulating foam core is sandwiched between two layers of wood sheathing panels and laminated to the wood sheathing. For example, the matrix 202 and the layer 204 may be attached together as a composite and then attached to the outer wood sheathing layer of an already-installed SIPS panel by stapling, nailing, gluing or the like. As another example, the layer 204 and the matrix 202 may be attached to the SIPS panel in separate steps by stapling, nailing, gluing or the like. As another example, only the matrix 202 may be attached to the SIPS panel by stapling, nailing, gluing or the like.

The thermal barrier layer 20 may be continuous over the entire base structure 10. That is, the thermal barrier layer 20 may cover 100% of the base structure 10. Alternatively, there may be small areas of the base structure 10 that are not covered by the thermal barrier layer 20. For example, in the case of a SIPS panel, the thermal barrier layer 20 might not be present at the edges of the panel, because the edges of the panel may be occupied entirely by wood, or by foamed insulation material. The area of the base structure 10 covered by the thermal barrier layer 20 may therefore be somewhat less than 100%, such as about 95%, or about 90%, or about 85%, or about 80%, or about 75% or less.

The external layer 30 in the exemplary roof structure depicted in FIGS. 1 and 2 is a metal roofing layer, with corrugations 32 (see FIG. 2). The external layer 30 is fastened to the base structure 10 in a known manner, such as by screws that pass through the external layer 30 and into the base structure 10.

Figure 3:
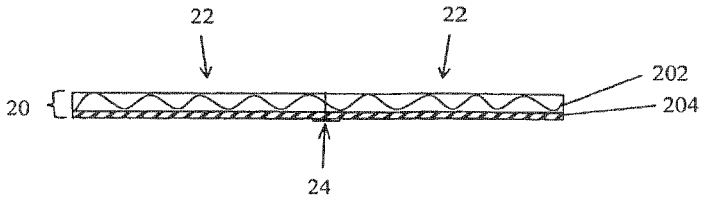
FIG. 3 illustrates a plurality of mat sections joined together in a continuous layer.

FIG. 3 illustrates a plurality of mat sections 22 joined together in a continuous layer to form the thermal barrier layer 20. For example, an adhesive strip 24 may be used to attach the layers 204 together. If, for example, the adhesive strip 24 and the layers 204 are waterproof, and an adhesive strip 24 extends along the entirety of each seam between the mat sections 22, then a continuous waterproof layer may cover the entire base structure 10. As an alternative to joining the layers 204 with adhesive strips, the layer 204 may, for example, be made larger than the matrix 202 in one direction, and attached to the matrix 202 such that it extends beyond the matrix 202 in one direction. Then, when installing the mat sections 22, the first mat section 22 may be installed with the extended part of the layer 204 positioned at the uphill side, the next mat section 22 may subsequently be installed such that its downhill edge overlaps the extended part of the layer 204, and so forth until the base structure 10 is completely covered. Adhesive may be used to attach the second mat 22 to the extended part of the layer 204 to provide a seal, but even if adhesive is not used, water will not reach the base structure 10 because of the overlapping arrangement of the layers 204.

Figure 4:
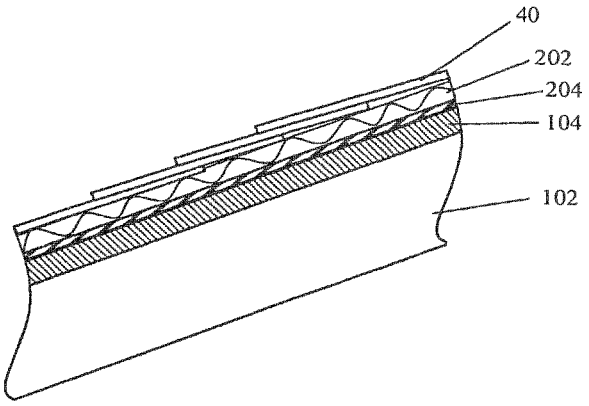
FIG. 4 illustrates a second exemplary roof structure.

FIG. 4 illustrates a second exemplary roof structure. This structure is the same as that shown in FIGS. 1 and 2, except that the external layer 40 is a layer of shingles, such as asphalt shingles, attached to the base structure 10 in a known manner such as by staples or nails.

While the invention has been described in conjunction with the specific embodiments described above, these embodiments should be viewed as illustrative and not limiting. Various changes, substitutes, improvements or the like are possible within the spirit and scope of the invention.

For example, while roof structures have been described specifically, the principles described above may also be applied to other building structures such as wall structures. Additionally, while pitched roofs have been depicted, various embodiments may be applied to flat or low-slope roofs.

The invention claimed is:

1. A building structure, comprising:

a base structure;

an external layer that comprises a metal roofing layer; and a thermal barrier positioned between the base structure and the external layer, the thermal barrier comprising a three-dimensional matrix of filaments made from a tangled net of polymer, wherein the material of the filaments of the three-dimensional matrix of filaments has a heat conductivity of 0.4 W/(m K) or lower.

2. The building structure according to claim 1 wherein the three-dimensional matrix of filaments has an open space of at least 75%.

3. The building structure according to claim 1 wherein the three-dimensional matrix of filaments comprises extruded filaments, randomly laid down on a forming substrate, which are bonded where they cross.

4. The building structure according to claim 3 wherein the filaments of the three-dimensional matrix of filaments are heat fused to one another.

5. The building structure according to claim 1 wherein the material of the filaments of the three-dimensional matrix of filaments is selected from nylon, polyester, high density polyethylene, low density polyethylene, medium density polyethylene, polyolefins, polyvinyl chloride, polyimides, polyethylene terephthalate (PET), polyamides, polyurethane, polyethylene, polypropylene, poly(4-methylbutene), polystyrene, polymethacrylate, poly(ethylene terephthalate) or poly(vinyl butyrate).

6. The building structure according to claim 1 wherein the material of the filaments of the three-dimensional matrix of filaments is selected from nylon, polyester or high density polyethylene.

7. The building structure according to claim 1 wherein the three-dimensional matrix of filaments has a thickness between 2 and 50 mm.

8. The building structure according to claim 1 wherein the three-dimensional matrix of filaments has a peak and valley configuration.

9. The building structure according to claim 1 wherein the thermal barrier comprises one or more additional layer(s).

10. The building structure according to claim 9 wherein the one or more additional layer(s) are positioned underneath the three-dimensional matrix of filaments.

11. The building structure according to claim 9 wherein the one or more additional layer(s) are positioned over the three-dimensional matrix of filaments.

12. The building structure according to claim 9 wherein the thermal barrier comprises at least two more additional layers wherein at least one additional layer is positioned underneath the three-dimensional matrix of filaments and wherein at least one additional layer is positioned over the three-dimensional matrix of filaments.

13. The building structure according to claim 9 wherein each additional layer is selected from a strength providing layer, a waterproof membrane, a water-resistant membrane, a waterproof breathable membrane or a radiant barrier membrane.

14. The building structure according to claim 9 wherein at least one of the additional layers is larger than the three-dimensional matrix of filaments in one direction.

15. The building structure according to claim 9 wherein the thermal barrier and the one or more additional layers are positioned between the base structure and the external layer and wherein the thermal barrier and the one or more additional layer(s) are joined together in advance to form a composite thermal barrier.

16. The building structure according to claim 15 wherein the three-dimensional matrix of filaments and the one or more additional layer(s) are joined together by stapling, nailing or gluing.

17. The building structure according to claim 1 wherein the thermal barrier covers at least 75% of the area of the base structure.

18. A method of producing a building structure having a thermal barrier, comprising:

positioning the thermal barrier on a base structure of the building structure, the thermal barrier comprising a three-dimensional matrix of filaments made from a tangled net of polymer; and attaching an external layer to the base structure, such that the thermal barrier is positioned between the base structure and the external layer, the external layer comprising a corrugated metal layer, wherein the material of the filaments of the three-dimensional matrix of filaments has a heat conductivity of 0.4 W/(m K) or lower.

19. The method according to claim 18 wherein the external layer comprises a metal roofing layer.

20. The method according to claim 18 wherein the thermal barrier comprises one or more additional layer(s).

21. The method according to claim 20 wherein the thermal barrier and the one or more additional layers are positioned between the base structure and the external layer and wherein the thermal barrier and the one or more additional layer(s) are joined together in advance to form a composite thermal barrier.

22. The method according to claim 18 further comprising joining the three-dimensional matrix of filaments to the base structure by stapling, nailing or gluing, separate from attaching the external layer to the base structure.

23. The method according to claim 18 wherein the external layer includes corrugations.

24. A building structure, comprising:

a base structure;

an external roofing layer that has a heat conductivity of at least 10 W/(m K); and a thermal barrier positioned between the base structure and the external roofing layer, the thermal barrier comprising a three-dimensional matrix of filaments made from a tangled net of polymer.

25. The building structure according to claim 24 wherein the external roofing layer has a heat conductivity of from 10 W/(m K) to 385 W/(m K).

26. The building structure according to claim 24 wherein the external roofing layer has a heat conductivity of from about 14 W/(m K) to 385 W/(m K).

27. The building structure according to claim 24 wherein the external roofing layer includes corrugations.

28. A method of producing a building structure having a thermal barrier, comprising:

positioning the thermal barrier on a base structure of the building structure, the thermal barrier comprising a three-dimensional matrix of filaments made from a tangled net of polymer; and attaching a corrugated external layer to the base structure, such that the thermal barrier is positioned between the base structure and the corrugated external layer, the corrugated external layer having a heat conductivity of at least 10 W/(m K).

29. The method according to claim 28 wherein the corrugated external layer has a heat conductivity of from 10 W/(m K) to 385 W/(m K).

30. The method according to claim 28 wherein the corrugated external layer has a heat conductivity of from about 14 W/(m K) to 385 W/(m K).

* * * * *